US011543222B2

(12) United States Patent
Kriel

(10) Patent No.: US 11,543,222 B2
(45) Date of Patent: Jan. 3, 2023

(54) NON-DETONATING CARTRIDGE

(71) Applicant: Fowlds 3 Limited, Tortola (VG)

(72) Inventor: Johannes Nicolaas Kriel, Somerset West (ZA)

(73) Assignee: Fowlds3 Limited, Tortola (VG)

( * ) Notice: Subject to any disclaimer, the term of this patent is extended or adjusted under 35 U.S.C. 154(b) by 0 days.

(21) Appl. No.: 17/261,455

(22) PCT Filed: Jul. 18, 2019

(86) PCT No.: PCT/IB2019/056157
§ 371 (c)(1),
(2) Date: Jan. 19, 2021

(87) PCT Pub. No.: WO2020/016826
PCT Pub. Date: Jan. 23, 2020

(65) Prior Publication Data

US 2021/0164763 A1 Jun. 3, 2021

(30) Foreign Application Priority Data

Jul. 19, 2018 (ZA) ..... 2018/04858

(51) Int. Cl.
*F42C 15/34* (2006.01)

(52) U.S. Cl.
CPC ..... *F42C 15/34* (2013.01)

(58) Field of Classification Search
CPC ..... F42C 15/18; F42C 15/184; F42C 15/34
(Continued)

(56) References Cited

U.S. PATENT DOCUMENTS 3,015,275 A 1/1962 Peyton et al.
3,926,122 A * 12/1975 Wolterman ..... F42C 15/184 102/226

(Continued)

FOREIGN PATENT DOCUMENTS

DE 10303361 A1 * 8/2004 ..... F42C 11/006
DE 102011105864 A1 * 12/2012 ..... F42C 15/184

(Continued)

OTHER PUBLICATIONS

International Search Report Form PCT/ISA/210, and Written Opinion Form PCT/ISA/237, International Application No. PCT/IB2019/056157 pp. 1-10 International Filing Date Jul. 18, 2019 dated Jul. 1, 2020.

*Primary Examiner* — Reginald S Tillman, Jr.
(74) *Attorney, Agent, or Firm* — George McGuire

(57) ABSTRACT

This invention relates to a non-detonating cartridge containing an explosive composition, and more particularly but not exclusively to a non-detonating cartridge having enhanced safety characteristics. The cartridge includes a container including a cavity suitable for receiving a low explosive composition; an initiator, for in use initiating the explosive composition inside the cavity; and a shielding member which is displaceable relative to the container between a safe position, in which the initiator is shielded from the cavity such that initiation of the initiator does not result in initiation of the explosive composition, and a live position in which the initiator is exposed to the cavity to permit initiation of the explosive composition. The cartridge is characterised in that the shielding member is slideably displaceable relative to the container.

19 Claims, 5 Drawing Sheets

(58) Field of Classification Search
USPC ..... 102/222, 202.1
See application file for complete search history.

(56) References Cited

U.S. PATENT DOCUMENTS

| | | | | | |
|---|---|---|---|---|---|
| 4,006,689 | A * | 2/1977 | Bastide | ..... | F42C 9/10 102/226 |
| 4,986,184 | A * | 1/1991 | Kude | ..... | F42C 15/184 102/247 |
| 6,634,301 | B1 * | 10/2003 | Mulinix | ..... | F42C 15/184 102/229 |

FOREIGN PATENT DOCUMENTS

| | | | | | |
|---|---|---|---|---|---|
| EP | 2645049 | A2 | 10/2013 | | |
| WO | WO-2005111533 | A1 * | 11/2005 | ..... | F42C 15/184 |
| WO | 2017145064 | A1 | 8/2017 | | |

* cited by examiner

NON-DETONATING CARTRIDGE

CROSS-REFERENCE TO RELATED APPLICATIONS

This is a National Stage Application, filed under 35 U.S.C. 371, of International Patent Application No. PCT/IB2019/056157, filed on Jul. 18, 2019, which claims priority to a South African patent application No. 2018/04858 filed on Jul. 19, 2018, the disclosures of which are incorporated herein by reference in their entireties.

FIELD OF THE INVENTION

This invention relates to a non-detonating cartridge containing an explosive composition, and more particularly but not exclusively to a non-detonating cartridge having enhanced safety characteristics. The invention extends to a non-detonating cartridge including an initiator, but is not limited thereto.

BACKGROUND TO THE INVENTION

Explosive cartridges are widely used in mining, excavation and construction. Traditionally, high explosive compositions have been used but more recently low explosive compositions, which are non-detonating, have become more popular due to their good performance and enhanced safety compared to high explosive compositions.

High (detonating) explosive compositions, such as TNT and dynamite, are characterized by extremely rapid decomposition and development of high pressures irrespective of the condition of confinement. Low (non-detonating) explosive compositions, such as black powders and propellants, deflagrate meaning that they are merely fast burning resulting in the accompanying production of gas at relatively low pressures.

Non-detonating cartridges are reasonably well-known in trade and industry. Existing cartridges are made from plastic or other synthetic materials, which work well, but which results in significant plastic residue and material being left behind after the cartridge has been used. This is true not only for the primary cartridge, but also for the booster cartridges in use attached thereto. The sizes of these non-detonating cartridges are also relatively specific, because the cartridges comprises of plastic sleeves specifically moulded for the application. It is therefore not that simple to change the length or diameter of the cartridges.

Another characteristic of existing non-detonating cartridges is that they use low explosive compositions that require confinement for easy ignition and fast propagation. If a cartridge is not confined in a borehole or similarly restricted space, ignition of the low explosive composition charge typically has little effect other than the cartridge becoming ruptured or dismantled. For this reason it is permissible to transport low explosive composition cartridges with an initiation device, such as a fuse head, inserted in it provided certain safety requirements are met. One of these safety requirements is that accidental ignition of a cartridge in a carton should not cause the carton to rupture. Low explosive cartridges contain a gas generating compound, commonly a propellant or other gas generating compound or mixture. Although very rare, it is conceivable that an initiation device could be accidentally activated by an Electro Static Discharge (ESD), electromagnetic induction, or the like. Most cartridges available on the market do not include a safety mechanism which could forestall such an accidental activation.

Some embodiments of cartridges with enhanced safety features are disclosed in the applicant's prior application WO2017/145064, the content of which is incorporated herein by references. WO2017/145064 discloses a number of different mechanism by which the initiator of the cartridge is displaceable relative to the container between a safe position, in which the initiator is shielded from the explosive composition such that initiation of the initiator does not result in initiation of the explosive composition, and a live position in which the initiator is exposed to the explosive composition to permit initiation thereof. The mechanism typically takes the form of components that are rotatable relative to one another (for example the cap of the cartridge and the body of the cartridge), and which are relatively complicated and expensive to manufacture. It is also not that easy to see if the cartridge is in a safe or live position, and careful inspection is required. Additionally, existing safety mechanisms do not alter the geometry of the cartridge (for example the span), and a cartridge can be inserted into a borehole even if the cartridge is still in a safe position, which is not ideal.

In this specification "low explosive composition" shall have its widest meaning and include any suitable gas generating composition or mixture of materials, including propellants. An "initiator" shall mean any device capable of causing initiation or ignition of a low explosive composition.

It is an object of the invention to provide a non-detonating cartridge which will, at least partially, address the above shortcomings.

It is also an object of the invention to provide a non-detonating cartridge which will be a useful alternative to existing cartridges, and which will also alleviate disadvantages associated with existing cartridges.

SUMMARY OF THE INVENTION

In accordance with this invention there is provided a non-detonating cartridge including:

a container including a cavity suitable for receiving a low explosive composition;

an initiator, for in use initiating the explosive composition inside the cavity; and a shielding member which is displaceable relative to the container between a safe position, in which the initiator is shielded from the cavity such that initiation of the initiator does not result in initiation of the explosive composition, and a live position in which the initiator is exposed to the cavity to permit initiation of the explosive composition;

characterised in that the shielding member is slideably displaceable relative to the container.

There is provided for the shielding member to be at least partially securable in the safe position and in the live position.

The shielding member may be securable in the safe position by way of a protrusion extending from the shielding member engaging part of the cartridge.

The shielding member may be securable in the live position by way of a protrusion extending from the shielding member engaging part of the cartridge.

There is provided for the container to be in the form of a hollow sleeve for receiving the explosive composition.

There is provided for the cartridge to include at least one end cap for closing off the hollow sleeve.

There is provided for the initiator to be at least partially located inside the end cap.

There is also provided for an ignition tube to extend from the end cap into the sleeve of the container, with a first end of the ignition tube being secured to the end cap, and a second end of the ignition tube being located inside the interior of the sleeve in order for the ignition tube to bring the initiator in contact with the interior of the sleeve.

There is provided for the shielding member to be located between the initiator and the first end of the ignition tube.

There is provided for the shielding member to be in the form of a slideable element, preferably an elongate slideable element, which is slideably located inside the end cap, alternatively inside the sleeve, alternatively between the end cap and the sleeve.

The shielding member may be slideable in a radial direction relative to the cartridge.

In one embodiment the shielding member may have an aperture provided therethrough in order for the aperture to be offset relative to the initiator when the shielding member is in the safe position, and to be aligned with the initiator when the shielding member is in the live position.

There is further provided for at least part of the shielding member, preferably an end zone of the shielding member, to protrude from a periphery of the end cap when the shielding member is in a safe position.

There is also provided for the shielding member and the cap to have complementary engagement formations that retains the shielding member in either the safe position or the live position, but which will prevent unintended displacement of the shielding member between the two positions.

The complementary engagement formations may be in the form of one or more protrusions provided on the shielding member.

Further features according to this embodiment of the invention provide for the second end of the ignition tube that extends into the container to be closed off by a frangible membrane.

According to a further aspect of the invention there is provided an end cap for a non-detonating cartridge, the end cap including:

a body being securable to an end of a sleeve of the cartridge, the body having an opening extending therethrough;

a channel provided in the body; and a shielding member which is slideably displaceable inside the channel between a safe position in which a solid section of the shielding member overlies the opening, and a live position in which an aperture in the shielding member is aligned with the opening in the body.

BRIEF DESCRIPTION OF THE DRAWINGS

Two preferred embodiment of the invention are described by way of a non-limiting examples, and with reference to the accompanying drawings in which.

DETAILED DESCRIPTION WITH REFERENCE TO THE DRAWINGS

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings and are thus intended to include direct connections between two members without any other members interposed therebetween and indirect connections between members in which one or more other members are interposed therebetween. It is noted that, as used in this specification and the appended claims, the singular forms "a," "an," and "the," and any singular use of any word, include plural referents unless expressly and unequivocally limited to one referent. As used herein, the term "include" and its grammatical variants are intended to be non-limiting, such that recitation of items in a list is not to the exclusion of other like items that can be substituted or added to the listed items.

Figure 1:
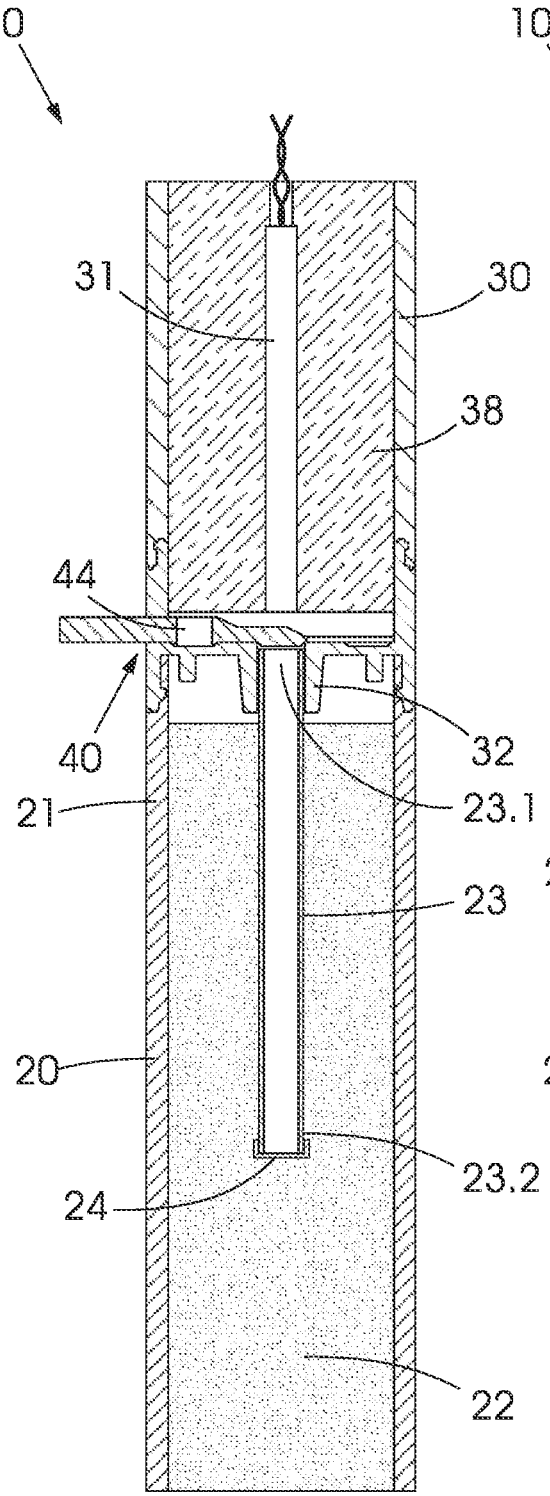
FIG. 1 is a cross-sectional side view of the non-detonating cartridge according to one embodiment of the invention, with the shielding member in a safe position.
Figure 2:
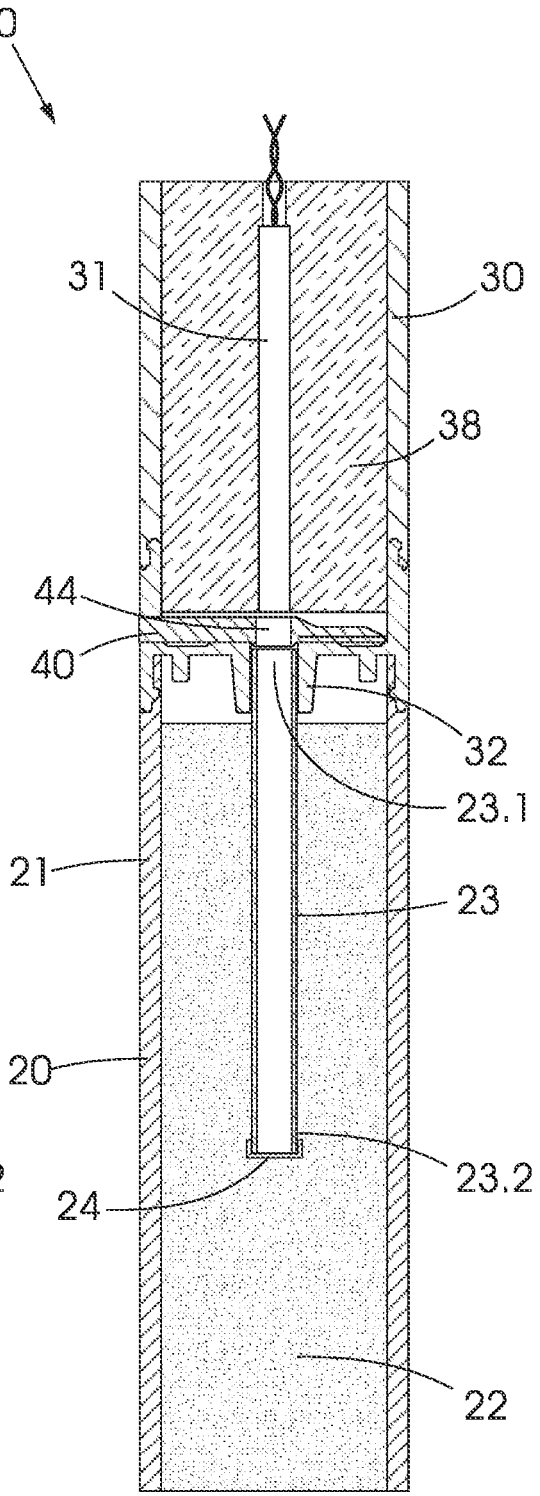
FIG. 2 is a cross-sectional side view of the non-detonating cartridge of FIG. 1 with the shielding member in a live position.
Figure 3:
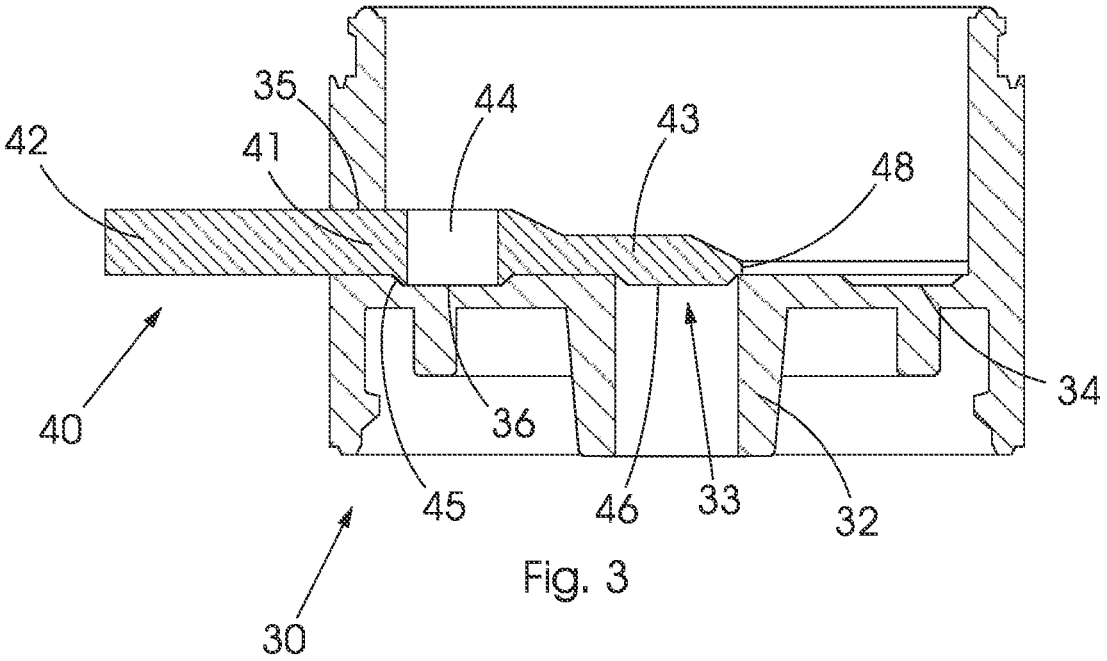
FIG. 3 is a cross-sectional side view of an end cap of the non-detonating cartridge of FIG. 1, with the shielding member in a safe position.
Figure 4:
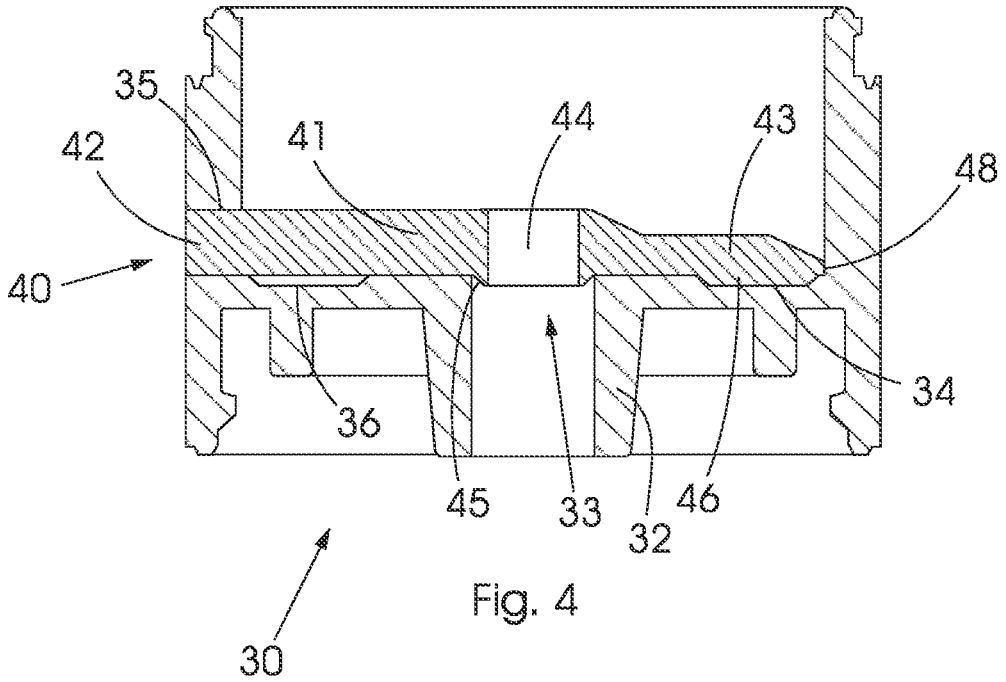
FIG. 4 is a cross-sectional side view of an end cap of the non-detonating cartridge of FIG. 1, with the shielding member in a live position.
Figure 5:
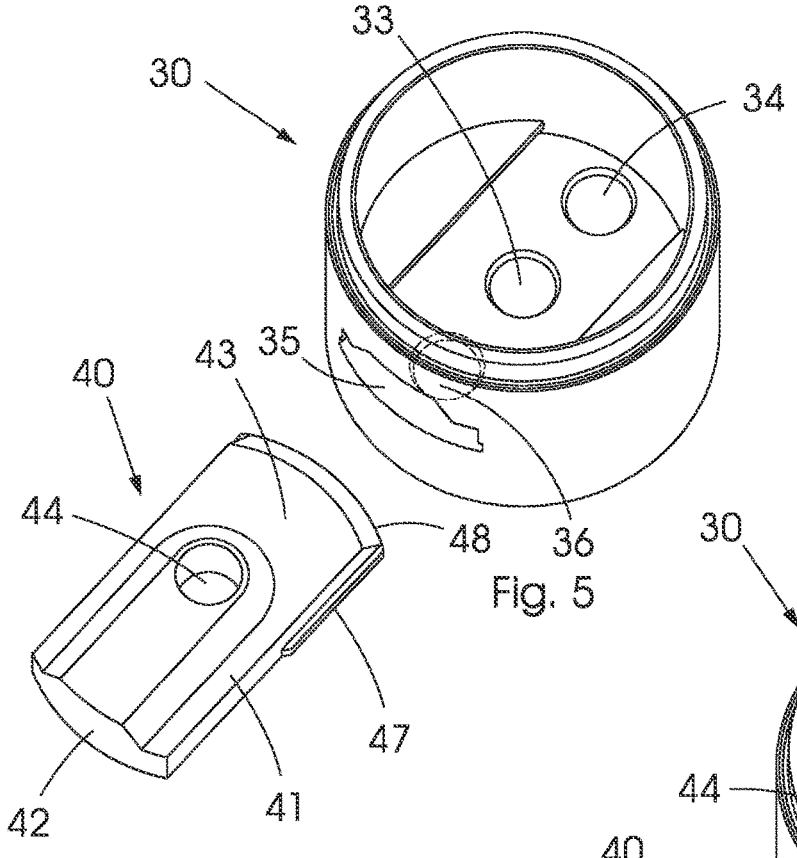
FIG. 5 is a top, exploded perspective view of the end cap and shielding member of FIG. 1.
Figure 6:
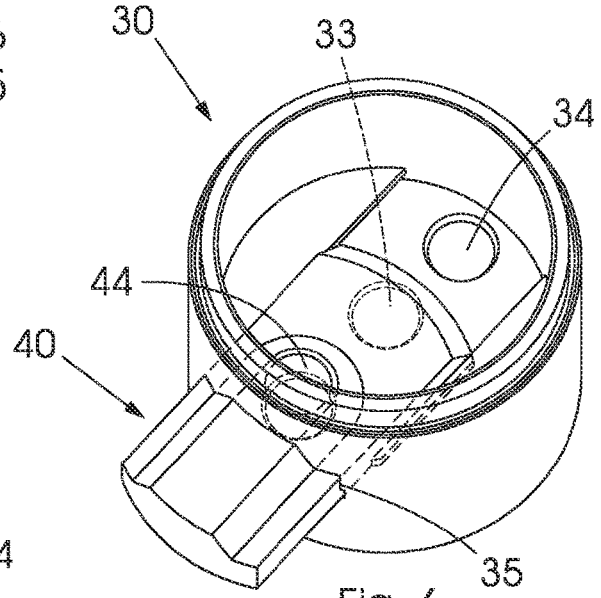
FIG. 6 is a top perspective view of the end cap and shielding member of FIG. 1 with the shielding member in a safe position.
Figure 7:
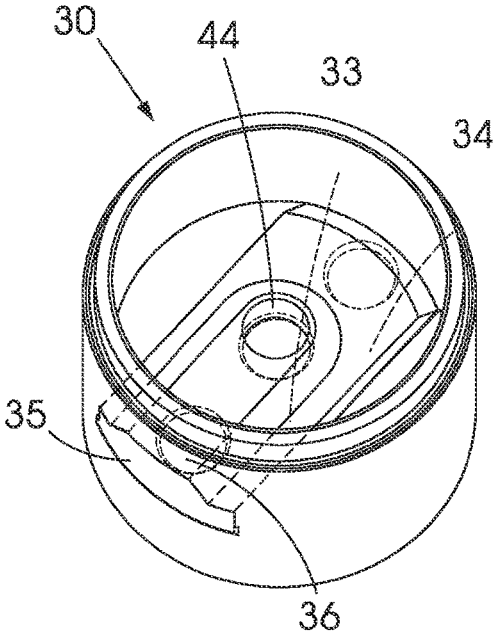
FIG. 7 is a top perspective view of the end cap and shielding member of FIG. 1 with the shielding member in a live position.
Figure 8:
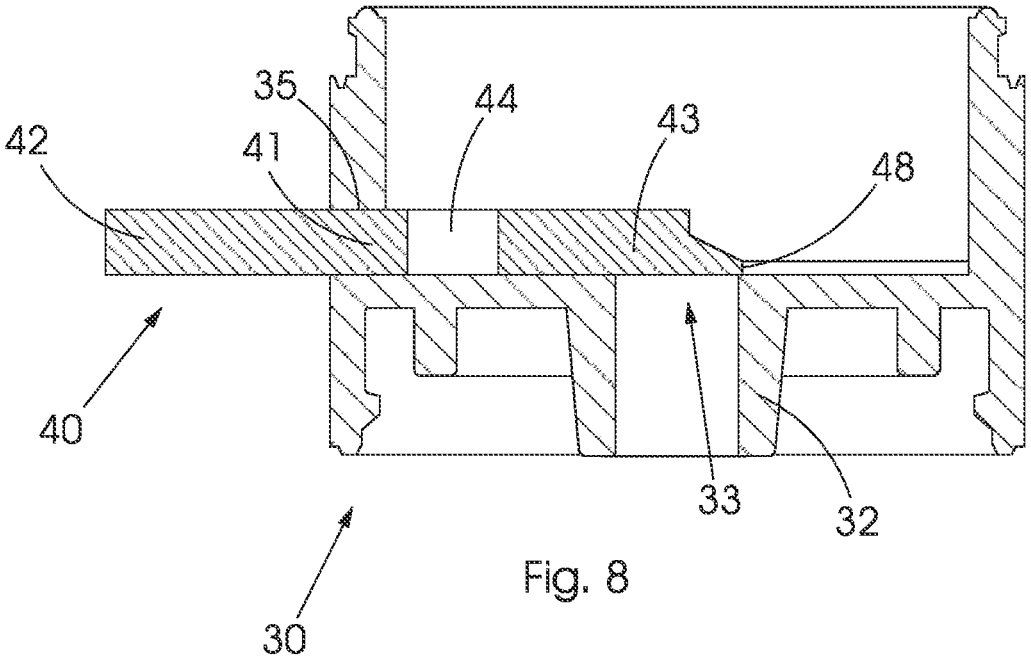
FIG. 8 is a cross-sectional side view of the non-detonating cartridge of a second embodiment of the invention, with the shielding member in a live position.
Figure 9:
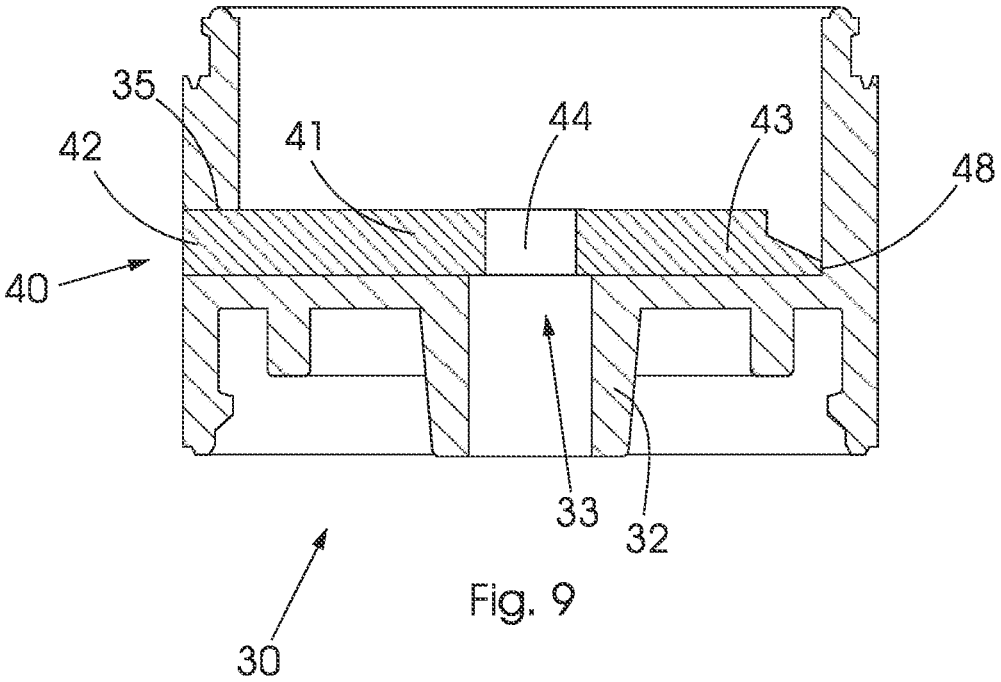
FIG. 9 is a cross-sectional side view of an end cap of the non-detonating cartridge of FIG. 8, with the shielding member in a safe position.
Figure 10:
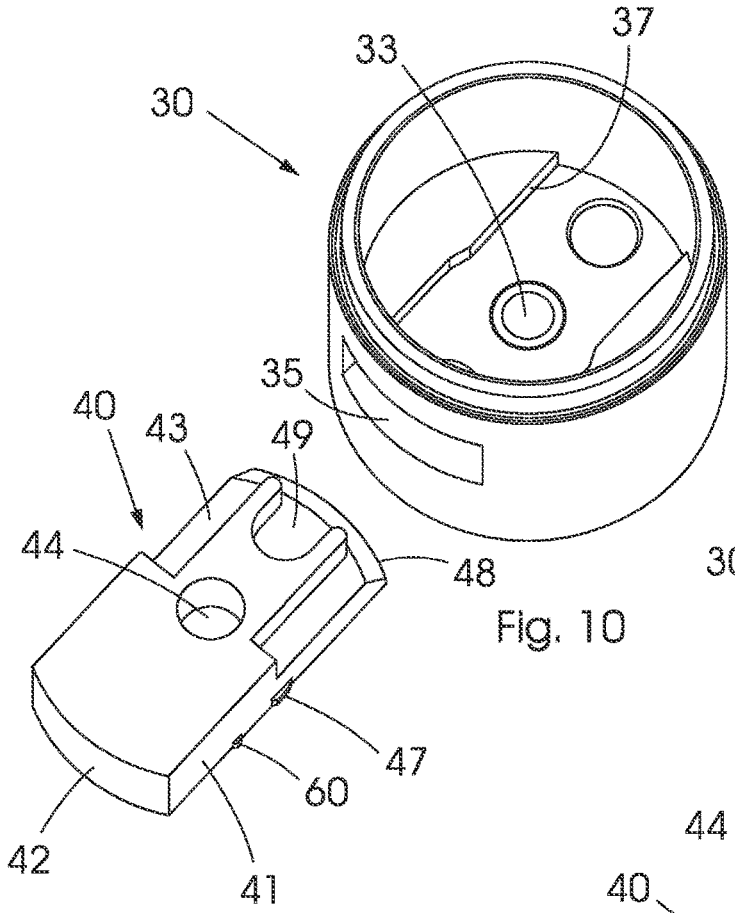
FIG. 10 is a top, exploded perspective view of the end cap and shielding member of FIG. 8.
Figure 11:
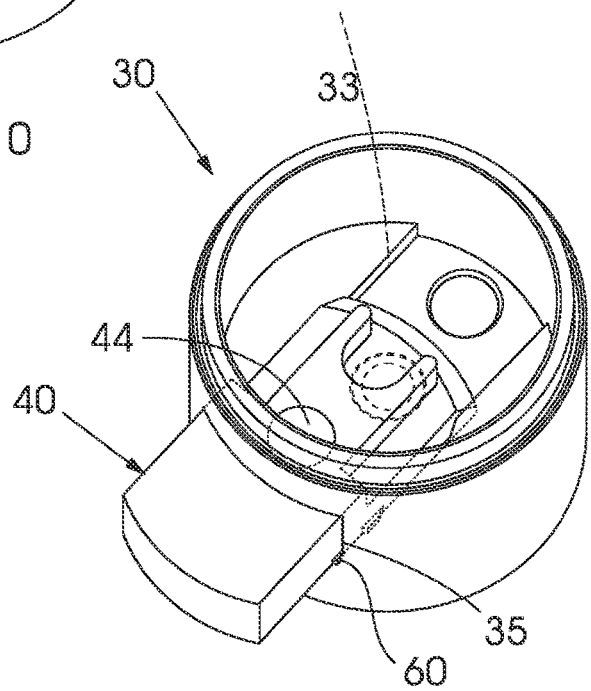
FIG. 11 is a top perspective view of the end cap and shielding member of FIG. 8 with the shielding member in a safe position.
Figure 12:
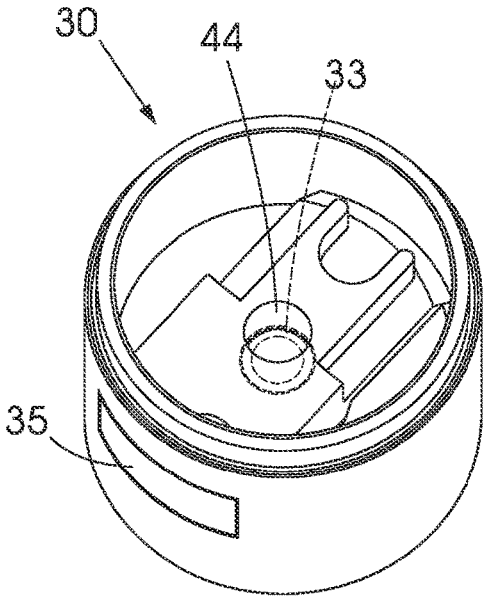
FIG. 12 is a top perspective view of the end cap and shielding member of FIG. 1 with the shielding member in a live position.

Referring to the drawings, in which like numerals indicate like features, a non-limiting example of a non-detonating cartridge in accordance with the invention is generally indicated by reference numeral 10. A first embodiment of the invention is shown in FIGS. 1 to 7, and a second embodiment is shown in FIGS. 8 to 12. The underlying inventive concept is present in both embodiments, and the two embodiments only include some variations in putting the invention into effect. The first embodiment will accordingly be described in detail, followed by a description limited to the variations present in the second embodiment.

Referring to FIGS. 1 to 7, the non-detonating cartridge 10 comprises a hollow sleeve 20 which is in use filled with an explosive composition 22. The hollow sleeve 20 is in the form of an elongate tubular sleeve, which is circular in cross-section. The sleeve has at least one open end 21.

The at least one open end 21 of the sleeve (it will be appreciated that both ends may be open) are closed off by way of an end cap 30, while a further end cap will be provided in the case where both ends of the sleeve are open (not shown). In this embodiment, the end caps are made of a plastic material, but it will be appreciated that the end caps may also be made from high density foam or other similar material.

It will be appreciated that the end cap 30 may include an upper lid section 30.1 that houses the initiator 31 and the foam sleeve 38, and a lower base section 30.2 that houses the sliding member 40. For ease of assembly, the two parts will be manufactured separately and then connected to one another, but in this specification reference to the cap 30 generally refers to both components, i.e. the entire part that fits onto the container or sleeve 20.

The end cap 30, and in this example the lower section 30.2, is configured snugly to engage the open end 21 of the sleeve 22 by way of a friction fit, compression fit or snap fit. The cap 30 may also be attached to the tube by glue or hot melt glue. As can be best seen in FIGS. 3 and 4, the end cap includes a base plate 30.3 from which depends an ignition tube receiving sleeve 32, suitable for receiving and housing an end of an ignition tube 23. The end 23.1 of the ignition tube 23.1 fits inside the tube receiving sleeve 32 by way of a friction fit, and may also be glued inside the sleeve 32. An initiator opening 33 is provided in the base plate 30.3, and is co-axial with the sleeve 32.

An initiator 31 is at least partially located inside the end cap 30. The initiator 31 is, in this embodiment, an electric ignitor fuse, sometimes referred to as an electric match or fuse head, which provides a source of extremely hot gas and particles when activated or initiated. The initiator 31 is located inside a foam sleeve 38, the foam sleeve being configured snugly to fit inside the end cap 30, and including a bore configured and dimensioned snugly to receive the initiator 31. An end of the initiator 31 is in use located in the proximity of the initiator opening 33, which is defined by an opposing opening of the ignition tube receiving sleeve 32. The initiator 31, ignition tube 23, ignition tube receiving sleeve 32 and the initiator opening 33 are therefore all axially aligned.

A slot 35, suitable for receiving a displaceable shielding member 40 as discussed in more detail below, is provided in the end cap 30, and more particularly in a lower base section 30.2 of the end cap 30. The slot 35 is orientated in a radial direction relative to the end cap 30, and is located immediately adjacent the position of the initiator opening 33 in order for part of the shielding member to overlie the opening 33. The slot 35 opens into a channel that is configured and dimensioned for slidingly receiving the shielding member.

In this embodiment one or more securing depressions 34, 36 are provided in a base plate 30.3 of the lower base section 30.2 of the end cap 30, the purpose of which is described in more detail below. Each depression 34, 36 is in the form of a circular blind hole having tapered edges.

An ignition tube 23 extends from the end cap 30 into the hollow bore of the sleeve 20, and more particular up to a proximal zone of the sleeve 20. The ignition tube 23 is in the form of an elongate tubular conduit having a first end 23.1 and a second end 23.2. The first end 23.1 is located inside the sleeve 32 of the end cap 30. The first end 23.1 is axially aligned with the initiator 31, in order for the initiator to be in flow communication with the explosive composition 22 when the displaceable shielding member 40 is in a live position as discussed in more detail below. A gap is provided between the first end 23.1 of the tube 23 and the initiator 31. The second end 23.2 of the ignition tube 23 is sealed off by way of a frangible membrane 24, which may for example be in the form of a sock-like sleeve that is pulled over the open end of the ignition tube 23.

A displaceable shielding member 40 is provided in the end cap 30 of the cartridge 10, and is displaceable relative to the hollow sleeve 20 between a safe position (FIGS. 1, 3, and 6) in which at least part of a solid section of the shielding member 40 is located between the initiator 31 and the first end 23.1 of the ignition tube 23 in order for the initiator 31 to be shielded from the explosive composition 22 such that initiation of the initiator does not result in initiation of the explosive composition, and a live position (FIGS. 2, 4 and 7) in which the shielding member 40 is displaced to a position where it does not define an obstruction between the initiator 30 and the first end 32.1 of the ignition tube 23, in order for the initiator 31 to be exposed to the explosive composition 22 to permit initiation thereof, such that initiation of the initiator results in initiation of the explosive composition. There is provided for a sealing element, such as an o-ring, to be located around the opening 33 in the cap 30 so as to create a seal between the shielding member 40 and the opening 33 (by abutting the surface of the shielding member) when the shielding member is in the safe position.

In this embodiment, the displaceable shielding member 40 is in the form of a slideable element located in the slot 35 provided in the end cap 30. The slideable element comprises an elongate, flat body 41 having an operatively outer end 42 and an operatively inner end 43. An aperture 44 extends through the body 41, the configuration being such that the aperture 44 is axially aligned with the initiator opening 33 when the shielding member 40 is in a live position, but displaced from the initiator opening 33 when the shielding member 40 is in the safe position, thus effectively blocking or shielding the initiator 31 from the ignition tube 23. The shielding member may be made from a plastic material, form wood, or any other suitable material.

Two protrusions (45 and 46) extend from the body 41 of the shielding member 40, and are configured and dimensioned, in use, snugly to fit inside the securing depressions 34 provided in the cap 30. When the shielding member is in a safe position, the protrusion 45 extending from the periphery of the aperture 44 will be located inside a first depression 36 provided in the cap 30, thus retaining the shielding member 40 in the safe position. When a sufficient inwardly directed force is exerted onto the shielding member 40, the protrusion 45 will disengage from the depression 36, and the shielding member 40 will be displaced to the live position. When it reaches the live position, the protrusion 46 extending from an end section of the body 41 of the shielding member 40 will engage the second complementary configured and dimensioned depression 34 provided in the cap, thus retaining the shielding member 40 in the live position. This configuration will prevent accidental displacement of the shielding member in either direction.

An additional advantage of this arrangement is that the outer end 42 of the slideable element protrudes from the cartridge 10 when the displaceable safety shield is in a safe position (FIG. 1), thus preventing the cartridge 10 from being inserted into a blast hole whilst in a safe condition (in cases where the diameters of the blast hole and cartridge are sufficiently similar), and also giving a clear visible indication that the cartridge is still in a safe condition.

A second embodiment of the invention is shown in FIGS. 8 to 12. As mentioned above, only the variations will be described, as the two embodiments are in essence very similar. A first difference between the two embodiments is that in the second embodiment no protrusions (45 and 46) extend from the body 41 of the shielding member 40. A first protrusion 47 and a second protrusion 60 do, however extend from the side of the body 41, and fulfils a similar function. The first protrusion 47 will be urged into a friction fit with a step formation 37 (provided at an end of the channel in the cap 30 inside which the shielding member is displaced) when the shielding member 40 is displaced toward the live position, thus securely retaining the shielding member 40 in the live position. The second protrusion 60 will in turn retain the shielding member in the safe position due to the fact that it extends beyond the width of the slot 35 in the cap. Only when a suitable force is exerted on the shielding member 40 will the second protrusion 60 be inwardly displaced in order to allow displacement of the shielding member towards the live position. The second protrusion 60 may be resilient, and/or a pocket may be provided in the body adjacent the second protrusion to create or improve the resilience. In this embodiment a locating formation 49 is provided on the shielding member, and an end of the initiator may be located inside the locating formation 49 when the shielding member 40 is in the safe position.

Some of the primary advantages of the invention include:

Provision of a detonator with a safety mechanism, but which is simple in its construction and operation;

Includes measures for retaining the shielding member in both the safe position and the live position;

The shielding member extends from the cartridge and acts as a visual cue that the cartridge is in a safe position, whilst also preventing the cartridge from being installed in a borehole while in a safe position.

It will be appreciated that the above are only two embodiments of the invention and that there may be many variations without departing from the spirit and/or the scope of the invention. It is easily understood from the present application that the particular features of the present invention, as generally described and illustrated in the figures, can be arranged and designed according to a wide variety of different configurations. In this way, the description of the present invention and the related figures are not provided to limit the scope of the invention but simply represent selected embodiments.

The skilled person will understand that the technical characteristics of a given embodiment can in fact be combined with characteristics of another embodiment, unless otherwise expressed or it is evident that these characteristics are incompatible. Also, the technical characteristics described in a given embodiment can be isolated from the other characteristics of this embodiment unless otherwise expressed.

The invention claimed is:

1. A non-detonating cartridge comprising:

a container including a cavity suitable for receiving a low explosive composition;

an initiator, for in use initiating the explosive composition inside the cavity; and a shielding member which is displaceable relative to the container between a safe position, in which the initiator is shielded from the cavity such that initiation of the initiator does not result in initiation of the explosive composition, and a live position in which the initiator is exposed to the cavity to permit initiation of the explosive composition;

characterised in that the shielding member is slideably displaceable relative to the container and in which at least part of the shielding member protrudes from a periphery of the cartridge when the shielding member is in a safe position;

and in which the shielding member is securable in the safe position by way of a protrusion extending from the shielding member that engages a complementary part of the cartridge when the shielding member is in a safe position.

2. The non-detonating cartridge of claim 1 in which the shielding member is releasably securable in the safe position and in the live position.

3. The non-detonating cartridge of claim 1 in which the shielding member is securable in the live position by way of a protrusion extending from the shielding member that engages a complementary part of the cartridge when the shielding member is in a live position.

4. The non-detonating cartridge of claim 1 in which the container is in the form of a hollow sleeve suitable for receiving the explosive composition.

5. The non-detonating cartridge of claim 1 in which the shielding member is slideably located in an end cap of the cartridge.

6. The non-detonating cartridge of claim 5 in which an ignition tube extends from the end cap into the container, with a first end of the ignition tube being secured to the end cap, and a second end of the ignition tube being located inside the cavity of the container in order for the ignition tube to bring the initiator in contact with the cavity of the container.

7. The non-detonating cartridge of claim 6 in which the shielding member is located between the initiator and the first end of the ignition tube.

8. The non-detonating cartridge of claim 1 in which the shielding member is slideable in a radial direction relative to the cartridge.

9. The non-detonating cartridge of claim 1 in which the shielding member has an aperture provided therethrough in order for the aperture to be offset relative to the initiator when the shielding member is in the safe position, and to be aligned with the initiator when the shielding member is in the live position.

10. The non-detonating cartridge of claim 1 in which a second end of the ignition tube that extends into the container is closed off by a frangible membrane.

11. An end cap for a non-detonating cartridge, the end cap comprising:

a body being securable to an end of a sleeve of the cartridge, the body having an opening extending therethrough;

a channel provided in the body; and a shielding member which is slideably displaceable inside the channel between a safe position in which a solid section of the shielding member overlies the opening, and a live position in which an aperture in the shielding member is aligned with the opening in the body, in which at least part of the shielding member protrudes from a periphery of the body in use, when the shielding member is in a safe position, and wherein the shielding member is securable in the safe position by way of a protrusion extending from the shielding member that engages a complementary part of the body when the shielding member is in a safe position.

12. A non-detonating cartridge comprising:

a container including a cavity suitable for receiving a low explosive composition;

an initiator, for in use initiating the explosive composition inside the cavity; and a shielding member which is displaceable relative to the container between a safe position, in which the initiator is shielded from the cavity such that initiation of the initiator does not result in initiation of the explosive composition, and a live position in which the initiator is exposed to the cavity to permit initiation of the explosive composition;

characterised in that the shielding member is slideably displaceable relative to the container and in which at least part of the shielding member protrudes from a periphery of the cartridge when the shielding member is in a safe position, further characterised in which the shielding member is slideably located in an end cap of the cartridge and in which an ignition tube extends from the end cap into the container, with a first end of the ignition tube being secured to the end cap, and a second end of the ignition tube being located inside the cavity of the container in order for the ignition tube to bring the initiator in contact with the cavity of the container.

13. The non-detonating cartridge of claim 12 in which the shielding member is located between the initiator and the first end of the ignition tube.

14. The non-detonating cartridge of claim 12 in which the shielding member is releasably securable in the safe position and in the live position.

15. The non-detonating cartridge of claim 12 in which the shielding member is securable in the live position by way of a protrusion extending from the shielding member that engages a complementary part of the cartridge when the shielding member is in a live position.

16. The non-detonating cartridge of claim 12 in which the container is in the form of a hollow sleeve suitable for receiving the explosive composition.

17. The non-detonating cartridge of claim 12 in which the shielding member is slideable in a radial direction relative to the cartridge.

18. The non-detonating cartridge of claim 12 in which the shielding member has an aperture provided therethrough in order for the aperture to be offset relative to the initiator when the shielding member is in the safe position, and to be aligned with the initiator when the shielding member is in the live position.

19. The non-detonating cartridge of claim 12 in which a second end of the ignition tube that extends into the container is closed off by a frangible membrane.

* * * * *